US007762780B2

(12) United States Patent
Decardenas

(10) Patent No.: US 7,762,780 B2
(45) Date of Patent: Jul. 27, 2010

(54) BLADE ASSEMBLY IN A COMBUSTION TURBO-MACHINE PROVIDING REDUCED CONCENTRATION OF MECHANICAL STRESS AND A SEAL BETWEEN ADJACENT ASSEMBLIES

(75) Inventor: Rafael A. Decardenas, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 708 days.

(21) Appl. No.: 11/698,233

(22) Filed: Jan. 25, 2007

(65) Prior Publication Data

US 2008/0181779 A1 Jul. 31, 2008

(51) Int. Cl.
*F01D 11/00* (2006.01)

(52) U.S. Cl. ..... 416/193 A; 416/500

(58) Field of Classification Search ..... 416/500, 416/190, 193 A, 191, 248; 415/139, 134
See application file for complete search history.

(56) References Cited

U.S. PATENT DOCUMENTS

| | | | | |
|---|---|---|---|---|
| 2,912,223 | A | | 11/1959 | Hull, Jr. |
| 3,519,366 | A | | 7/1970 | Campbell |
| 3,751,183 | A | | 8/1973 | Nichols et al. |
| 3,752,598 | A | | 8/1973 | Bowers et al. |
| 3,807,898 | A | | 4/1974 | Guy et al. |
| 3,834,831 | A | | 9/1974 | Mitchell |
| 3,853,425 | A | | 12/1974 | Scalzo et al. |
| 3,887,298 | A | | 6/1975 | Hess et al. |
| 3,967,353 | A | | 7/1976 | Pagnotta et al. |
| 4,111,603 | A | | 9/1978 | Stahl |
| 4,242,045 | A | | 12/1980 | Grondahl et al. |
| 4,326,835 | A | | 4/1982 | Wertz |
| 4,343,594 | A | | 8/1982 | Perry |
| 4,422,827 | A | | 12/1983 | Buxe et al. |
| 4,524,980 | A | | 6/1985 | Lillibridge et al. |
| 4,551,064 | A | | 11/1985 | Pask |
| 4,580,946 | A | | 4/1986 | Bobo |
| 4,668,164 | A | | 5/1987 | Neal et al. |
| 4,767,260 | A | | 8/1988 | Clevenger et al. |
| 4,813,848 | A | | 3/1989 | Novotny |
| 4,872,812 | A | | 10/1989 | Hendley et al. |
| 5,139,389 | A | | 8/1992 | Eng et al. |
| 5,167,485 | A | | 12/1992 | Starkweather |
| 5,201,849 | A | | 4/1993 | Chambers et al. |
| 5,228,835 | A | | 7/1993 | Chlus |
| 5,236,309 | A | * | 8/1993 | Van Heusden et al. ..... 416/221 |
| 5,244,345 | A | | 9/1993 | Curtis |
| 5,256,035 | A | | 10/1993 | Norris et al. |
| 5,257,909 | A | | 11/1993 | Glynn et al. |
| 5,261,790 | A | * | 11/1993 | Dietz et al. ..... 416/193 A |
| 5,281,097 | A | | 1/1994 | Wilson et al. |
| 5,388,962 | A | | 2/1995 | Wygle et al. |
| 5,429,478 | A | | 7/1995 | Krizan et al. |
| 5,431,543 | A | * | 7/1995 | Brown et al. ..... 416/221 |
| 5,460,489 | A | | 10/1995 | Benjamin et al. |

(Continued)

FOREIGN PATENT DOCUMENTS

JP 02095702 A * 4/1990

*Primary Examiner*—Richard Edgar

(57) ABSTRACT

A blade assembly 100 (FIG. 5) configuration that includes a means for distributing mechanical stress (e.g., a stress dissipater 54) is provided. The stress dissipater is configured to reduce the concentration of a peak mechanical stress without compromising the effectiveness of a seal between adjacent rotating blade assemblies.

12 Claims, 5 Drawing Sheets

U.S. PATENT DOCUMENTS

| | | | | |
|---|---|---|---|---|
| 5,478,207 | A | 12/1995 | Stec | |
| 5,531,457 | A | 7/1996 | Tibbott et al. | |
| 5,599,170 | A | 2/1997 | Marchi et al. | |
| 5,655,876 | A | 8/1997 | Rock et al. | |
| 5,785,499 | A | 7/1998 | Houston et al. | |
| 5,803,710 | A | 9/1998 | Dietrich et al. | |
| 6,086,329 | A | 7/2000 | Tomita et al. | |
| 6,273,683 | B1 | 8/2001 | Zagar et al. | |
| 6,354,803 | B1 * | 3/2002 | Grover et al. | 416/190 |
| 6,851,932 | B2 * | 2/2005 | Lagrange et al. | 416/190 |
| 7,090,466 | B2 | 8/2006 | Honkamp et al. | |

* cited by examiner

FIG 1
PRIOR ART
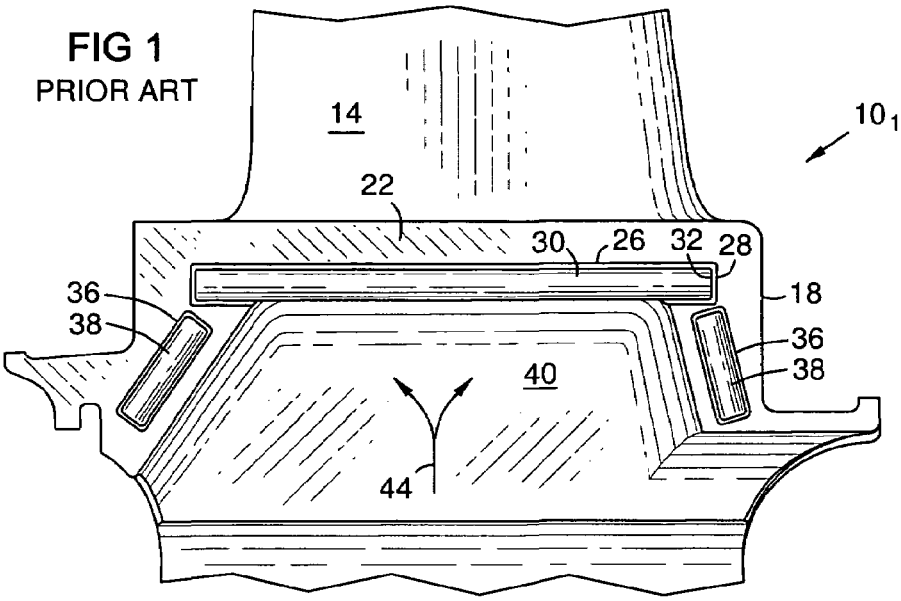
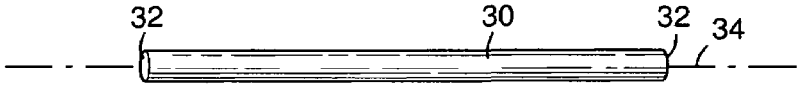
FIG 2
PRIOR ART
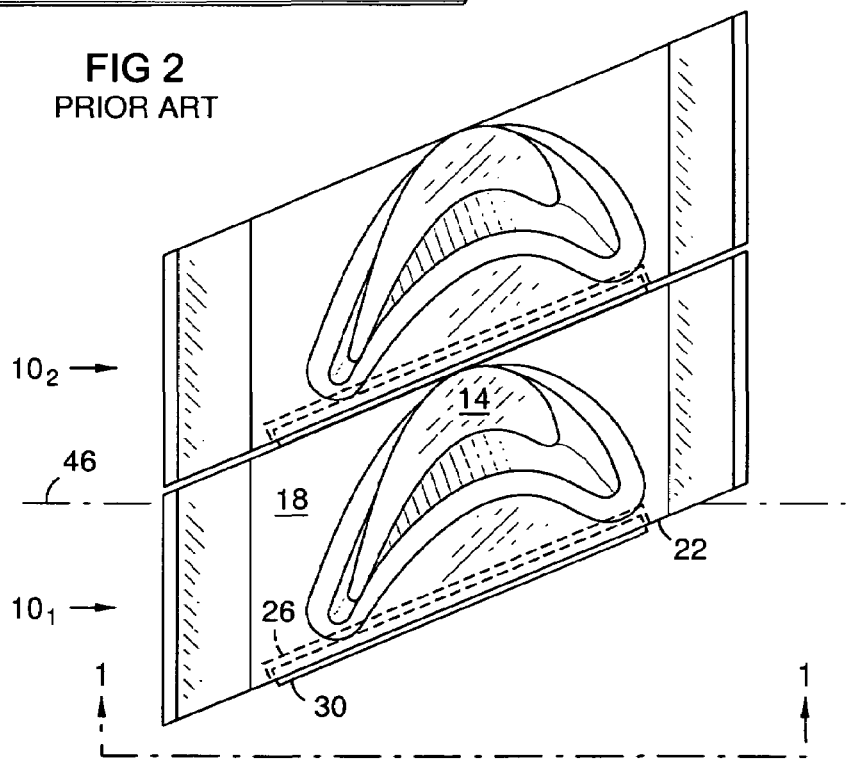
FIG 3
PRIOR ART

FIG 6
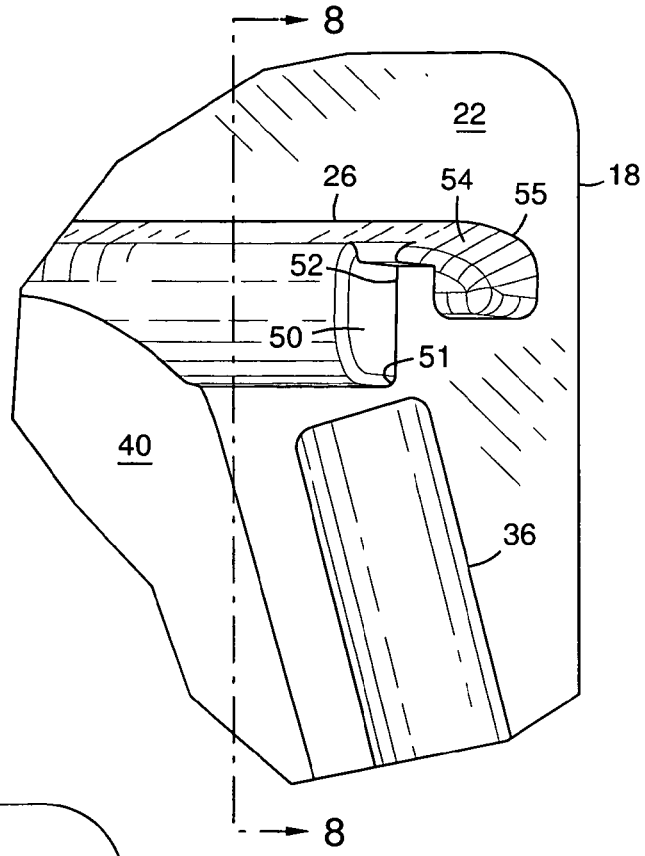
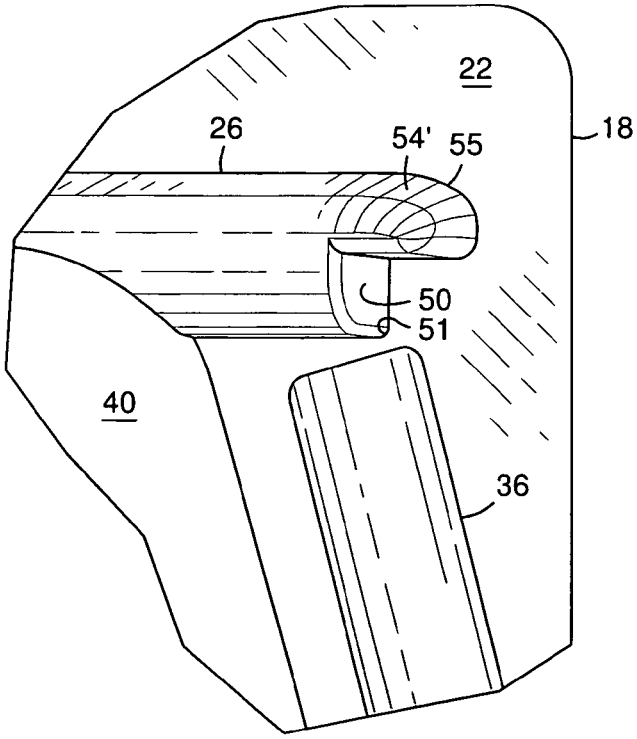
FIG 7

BLADE ASSEMBLY IN A COMBUSTION TURBO-MACHINE PROVIDING REDUCED CONCENTRATION OF MECHANICAL STRESS AND A SEAL BETWEEN ADJACENT ASSEMBLIES

FIELD OF THE INVENTION

This invention relates generally to the field of turbo-machines, and more particularly to the field of gas or combustion turbines, and specifically to an apparatus for sealing a gap between adjacent platforms in a row of rotating blades in a combustion turbine engine.

BACKGROUND OF THE INVENTION

Turbo-machines such as compressors and turbines generally include a rotating assembly having a centrally located rotor shaft and a plurality of rows of rotating blades attached thereto, and a corresponding plurality of rows of stationary vanes connected to the casing of the turbo-machine and interposed between the rows of rotating blades. A working fluid such as air or combustion gas flows through the rows of rotating blades and stationary vanes to transfer energy between the working fluid and the turbo-machine.

A blade of a turbo-machine typically includes a root section attached to the rotor, a platform section connected to the root section, and an airfoil section connected to the platform section on a side opposite from the root section. Corresponding surfaces of platform sections of adjacent blades in a row of blades abut each other to form a portion of the boundary defining the flow path for the working fluid. While it would be desirable to have adjacent platforms abut in a perfect sealing relationship, the necessity to accommodate thermal growth and machining tolerances results in a small gap being maintained between adjacent platforms.

It is known that turbo-machines have incorporated various types of devices to address the need of sealing the gap between the platforms of adjacent blades. Generally, such devices are generally either expensive to manufacture, lack sufficient sealing effectiveness for modern combustion turbine applications or have geometries vulnerable to thermally-induced stress that can develop along the platform side and can lead to the formation of cracks.

Accordingly, it is desirable to provide an improved blade assembly for sealing a gap between the platforms of adjacent rotating blades in a turbo-machine. It is further desirable to provide a blade assembly for sealing that can be manufactured by relatively inexpensive manufacturing techniques, has a geometry that reduces concentration of stress and avoids crack formation, and provides a desired sealing effectiveness.

BRIEF DESCRIPTION OF THE DRAWINGS

The invention is explained in the following description in view of the drawings that show:

FIG. 1 illustrates a prior art rotatable blade assembly as may be used in a combustion turbine engine.

FIG. 2 illustrates a sealing pin that may be disposed in a groove constructed in a platform section of a blade assembly.

FIG. 3 illustrates an isometric top view of a group of two prior art adjacent blade assemblies for sealing a gap there between.

FIG. 6 illustrates details regarding a first example embodiment of a groove end configured in accordance with aspects of the present invention.

FIG. 7 illustrates details regarding a second example embodiment of a groove end configured in accordance with aspects of the present invention.

DETAILED DESCRIPTION OF THE INVENTION

Figure 4:
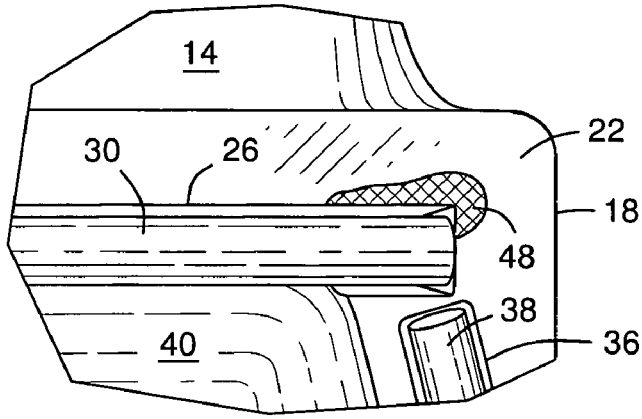
FIG 4 PRIOR ART
FIG. 4 illustrates an example area of high concentration of mechanical stress as may develop at the groove ends of the blade assembly of FIG. 1.

Modern combustion turbine engines may utilize a portion of the compressed air generated by the compressor section of the engine as a cooling fluid for cooling hot components of the combustor and turbine sections of the engine. In an open loop cooling system design, the cooling fluid is released into the working fluid flow after it has removed heat from the hot component. For the most advanced engines that are designed to operate at the highest efficiencies, a closed loop cooling scheme may be used. In a closed loop cooling system the cooling fluid is not released into the working fluid in the turbine, but rather is cooled and returned to the compressor section. In these high efficiency engines, the effectiveness of the seal between adjacent rotating blade platforms is important.

FIG. 1 illustrates a prior art rotatable blade assembly $\mathbf{10}_1$ as may be used in a combustion turbine engine. Assembly $\mathbf{10}_1$ includes a root section 40 for attaching the blade to a rotor assembly (not shown) and a platform section 18 attached to the root section 40. An airfoil 14 is attached to the platform section 18 on an opposite side from the root section 40. The airfoil 14 extracts heat and pressure energy from a working fluid as it passes over the blade assembly and converts the energy into mechanical energy by rotating the rotor shaft.

The platform section 18 is sealed and damped against a corresponding platform section of an adjoining blade assembly $\mathbf{10}_2$ (FIG. 3) by seal pins 30 and 38. FIG. 2 is representative of seal pin 30, such as may define a pin axis 34 that extends between mutually opposite pin ends 32. The pins 30 and 38 are set into grooves 26 and 36 formed into a surface 22 of the platform section 18. The grooves 26 and 36 are generally formed in a direction along their longitudinal dimension that is not tangential to a rotor axis 46 of the turbine, for example at an angle of about 7-14 degrees, or even as much as 30 degrees. As a result of this angle, centrifugal force created by the rotation of the rotor assembly will cause the pins 30 and 38 to be forced out of a resting position in the grooves 26 and 36 against a corresponding surface in the platform of the adjoining blade assembly, thereby providing a seal and a damping structure.

The structural arrangement of FIGS. 1-3 provides adequate sealing of the gap between adjacent blade assemblies for most applications. However, this design is subject to mechanical stresses that can develop along the platform side due to high thermal gradients. For example, in connection with groove 26, (generally the groove likely to be subjected to the highest thermal gradients due to its closer proximity to the hot working fluid) note that each end of the groove may respectively exhibit relatively sharp corners or surface discontinuities, (analogous to a bar on a flat plate). As illustrated in FIG. 4, these surface discontinuities tend to form areas of relatively high concentration of mechanical stress 48 in response to the thermal gradients. Service data collected from prior art blade assemblies show a propensity of crack formation at or near this location, e.g., near the respective ends of groove 26.

The inventor of the present invention has discovered an innovative blade assembly configuration that advantageously includes a means for distributing mechanical stress (e.g., a stress dissipater) configured to reduce the concentration of such stresses without compromising the effectiveness of the seal between adjacent rotating blade assemblies. In one example embodiment, a peak mechanical stress may be reduced by the stress dissipater by a factor ranging from about 0.4 to about 0.8.

Figure 5:
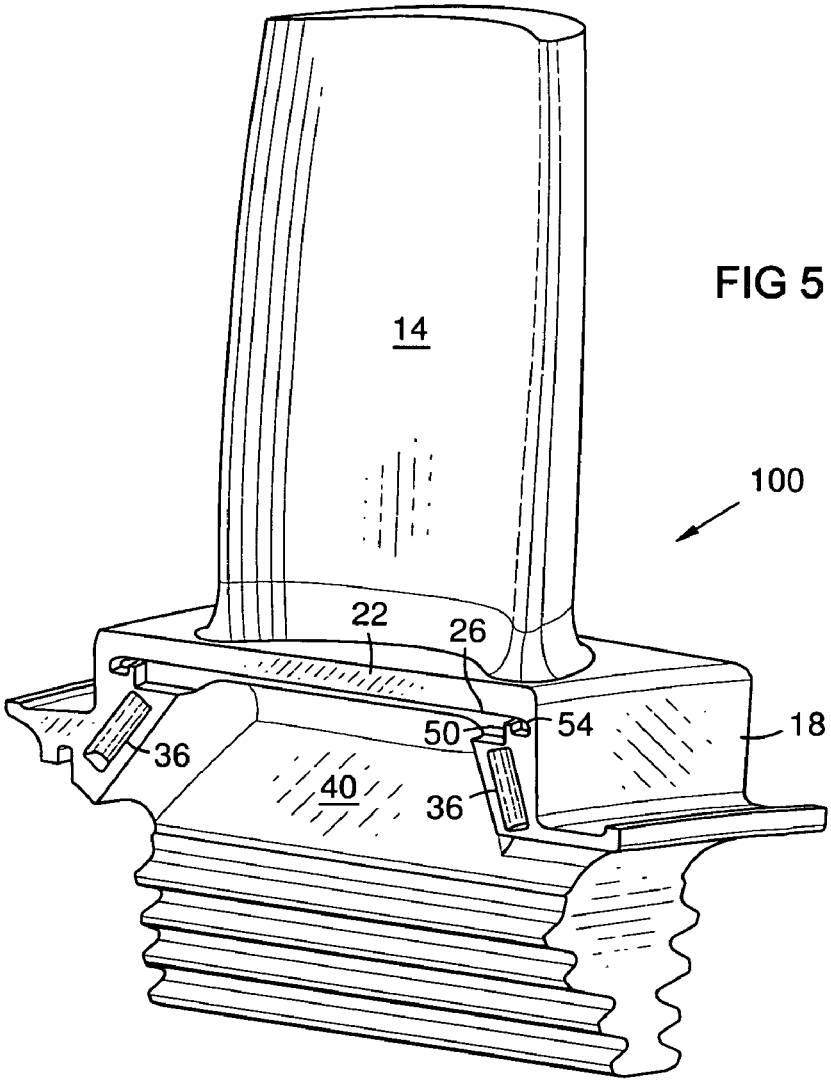
FIG. 5 illustrates a rotatable blade assembly embodying aspects of the present invention.

FIG. 5 is an isometric view of one example of a blade assembly 100 embodying aspects of the present invention. FIG. 5 shows a blade 14 having a platform 18 with a surface 22 where a groove 26 is formed. Groove 26 has a length and width that extend in a plane of surface 22. Groove 26 is adapted to receive a seal pin 30 (see FIGS. 9 and 10). The seal pin has an axis and a first end proximate a first end of the groove and a second end proximate a second end of the groove. The seal pin is operable to make sealing contact with a corresponding surface of an adjacent blade assembly to avoid leakage of a fluid through a gap between adjacent blade assemblies.

At least one end of the groove (and preferably each groove end) provides a first portion comprising a blocking surface 50 positioned generally normal to the seal pin axis. Blocking surface 50 is adjacent to a corresponding end of the seal pin. Each respective end of the groove may further provide a second portion comprising a lengthwise extension 54 of the groove that extends beyond the blocking surface. In one example embodiment, the first portion of the end of the groove (e.g., blocking surface 50) comprises a radially inner portion with respect to rotor axis 46, and the second portion of the end of the groove (e.g., lengthwise extension 54) comprises a radially outer portion with respect to the first portion.

As better appreciated in FIGS. 6 and 7, lengthwise extension 54 (54') of the groove may comprise a fillet 55, (e.g., an elliptically-shaped structure or other suitably curved structure) and may be configured to extend over a segment encompassing at least half the width of groove 26.

FIG. 6 illustrates details regarding an example embodiment wherein blocking surface 50 is formed on a dam 52 positioned between groove 26 and lengthwise extension 54 of the groove. As seen in FIG. 6, dam 52 may be configured to extend radially into a portion of the lengthwise extension of the groove. As also shown in FIGS. 6 and 7, blocking surface 50 may comprise a fillet 51 generally facing toward the lengthwise center of the groove. In one example embodiment, one may characterize aspects of the present invention as providing a slot with an end having a first portion with a first fillet radius, (e.g., fillet 55) and a second portion with a second fillet radius, (e.g., fillet 51) wherein the first fillet radius comprises an average radius sufficiently large to reduce a peak mechanical stress, (e.g., by a factor ranging from about 0.4 to about 0.8), while the second fillet radius comprises an average radius sufficiently smaller relative to the average of the first fillet radius to provide a relatively sharp turn for restricting fluid flow.

As shown in FIG. 7, one may optionally form surface 50 without a dam. It will be appreciated that the dam structure provides an incremental blocking surface that further impedes the flow of fluid around the end of the seal pin. Thus, the embodiment of FIG. 6 may be preferred for applications with relatively higher sealing requirements.

Figure 8:
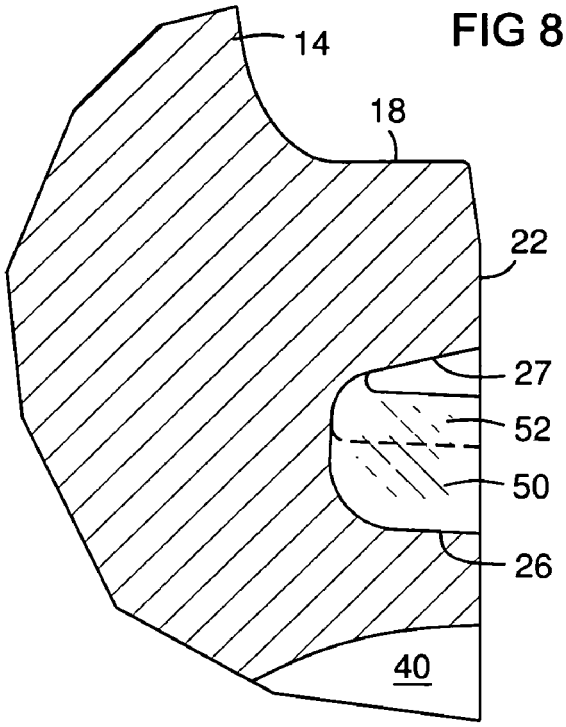
FIG. 8 illustrates a cross-sectional view along cutting line 8-8 shown in FIG. 6.

FIG. 8 is a cross-sectional view of blade assembly 100 along cutting line 8-8 as seen in FIG. 6. As shown in FIG. 8, an exemplary ramp 27 may be formed in the interior of each pin-receiving groove. For example, centrifugal force due to rotation of the rotor assembly causes the respective sealing pin (not shown in FIG. 8) to travel along ramp 27 to abut against a corresponding surface in the platform of the adjoining blade assembly, thereby providing a seal.

Figure 9:
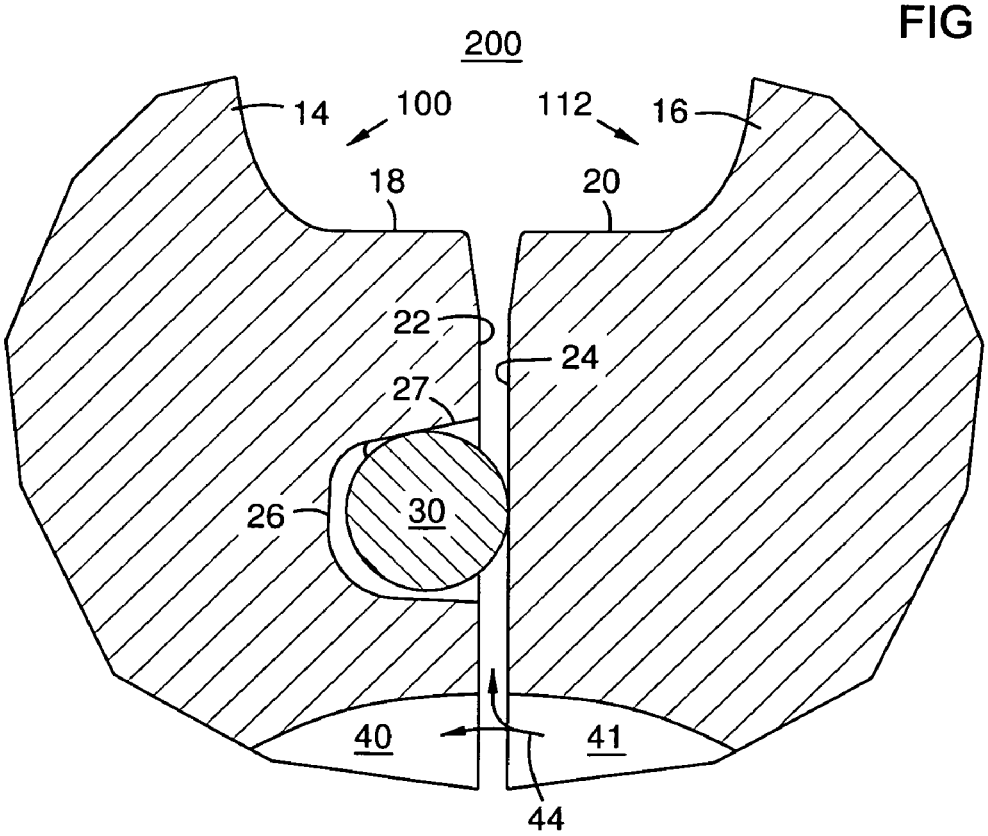
FIG. 9 illustrates a cross-sectional view of a group of two adjacent blade assemblies including a sealing pin for sealing a gap there between in accordance with aspects of the present invention.

FIG. 9 illustrates a group of blade assemblies 200 embodying aspects of the present invention. In one example embodiment, group of blade assemblies 200 includes a first blade 100 having a first platform 18 with a first surface 22. Group of blade assemblies 200 further includes a second blade 112 comprising a second platform 20 with a second surface 24 located adjacent the first surface and forming a gap there between. For example, sealing pin 30, when abutting against surface 24, prevents leakage of a flow of pressurized cooling air 44, such as may flow through respective cooling air plenums 40 and 41 constructed in the adjacent blade assemblies using techniques well-understood in the art.

Figure 10:
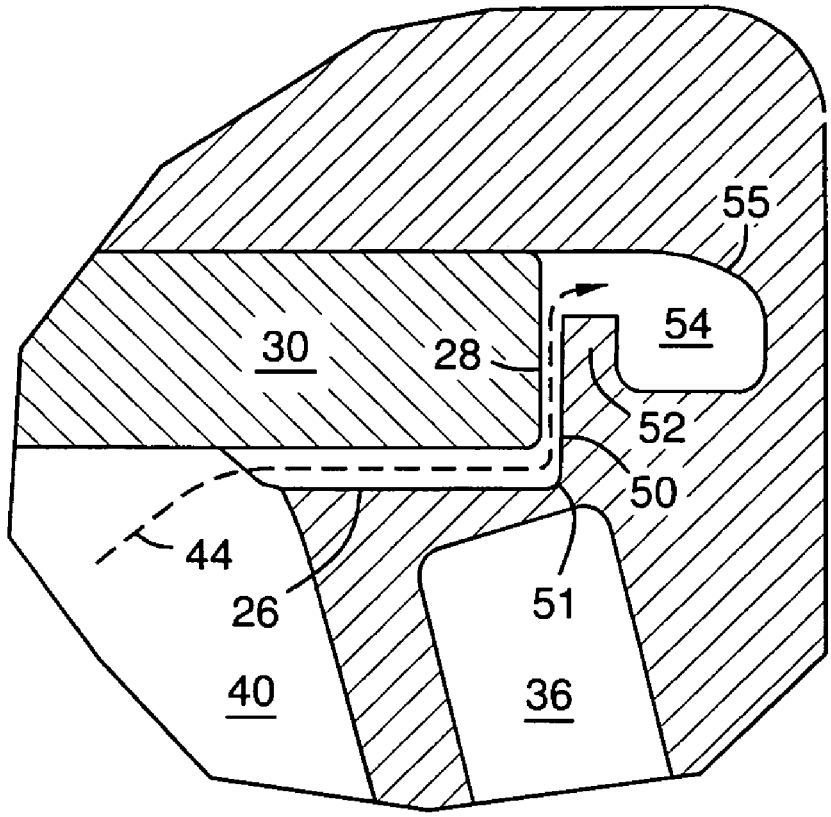
FIG. 10 illustrates a cross-sectional view of a groove end embodying aspects of the present invention as may be used for illustrating a fluid-deflecting surface positioned to interfere with a flow of cooling fluid around each end of the seal pin.

FIG. 10 illustrates a cross-sectional view of a groove end embodying aspects of the present invention as may be used for illustrating a fluid-deflecting surface 50 positioned to interfere with a flow of cooling fluid 44 around the end of the seal pin 30.

In operation, it will be appreciated that lengthwise extension 54 advantageously constitutes a mechanical stress dissipater for distributing mechanical stresses there through and the blocking structure 50 (or blocking structures 50 and 52) constitutes a fluid-deflecting surface positioned to impede a flow of cooling fluid around each end of the seal pin. Thus, it should be appreciated that aspects of the present invention elegantly and in cost-effective manner address both the need of 1) distributing peak levels of mechanical stresses that otherwise will develop around each end of the pin-receiving grooves and 2) providing an effective seal around each end of the seal pin.

While various embodiments of the present invention have been shown and described herein, such embodiments are provided by way of example only. Numerous variations, changes and substitutions may be made without departing from the invention herein. Accordingly, it is intended that the invention be limited only by the spirit and scope of the appended claims.

The invention claimed is:

1. A blade assembly in a turbo-machine, the assembly comprising:

a blade comprising a platform with a surface;

a groove formed in said surface, the groove configured to linearly extend along a groove axis in a direction generally along an axis of rotation of the turbo-machine, the groove positioned to extend between adjacent blade assemblies of a common row of blades of the turbo-machine, the groove adapted to receive a cylindrical seal pin having a circular cross-section along the groove axis, the seal pin further having at least one end proximate a corresponding end of the groove, the seal pin operable to make sealing contact with a corresponding surface of an adjacent blade assembly to avoid leakage of a fluid through a gap there between, wherein the end of the groove comprises a first portion comprising a blocking surface generally normal to the axis of rotation, the blocking surface adjacent to the end of the seal pin, and the end of the groove further comprises a second portion comprising a lengthwise extension of the groove beyond the blocking surface; and a dam disposed between the groove end and the lengthwise extension of the groove, the dam configured to radially extend from a bottom location at the end of the groove, the dam positioned substantially normal relative to the groove axis into a portion of the lengthwise extension of the groove, the dam constructed as an integral structure of the blade platform.

2. The blade assembly of claim 1, wherein said first portion of the end of the groove comprises a radially inner portion with respect to a rotor axis, and said second portion of the end of the groove comprises a radially outer portion with respect to the first portion.

3. The blade assembly of claim 1, wherein said lengthwise extension of the groove comprises a fillet configured to extend over a segment encompassing at least half a width of the groove.

4. A blade in a turbo-machine comprising:

a groove formed in a platform section of the blade, the groove configured to linearly extend along a groove axis in a direction generally along an axis of rotation of the turbo-machine, the groove positioned to extend between adjacent blade assemblies of a common row of blades of the turbo-machine, the groove adapted to receive a cylindrical seal pin having a circular cross-section along the groove axis, the seal pin operable to make a sealing contact with an adjacent blade platform to avoid leakage of a fluid through a gap there between, wherein at least one end of the groove comprises a first portion comprising a mechanical stress dissipater having a surface configured to distribute mechanical stresses there through, and wherein the end of the groove further comprises a second portion comprising a blocking structure having a fluid-deflecting surface positioned to impede a flow of fluid around the end of the seal pin, wherein the fluid-deflecting surface is positioned generally normal to the axis of rotation of the turbo-machine, and wherein the surface for distributing mechanical stress is arranged to provide a transition from a surface disposed in the direction generally along the axis of rotation of the turbo-machine to a surface generally normal to the axis of rotation of the turbo-machine.

5. The blade assembly of claim 4, wherein said first portion of the end of the groove comprises a radially inner portion with respect to a rotor axis, and said second portion of the end of the groove comprises a radially outer portion with respect to the first portion.

6. The blade assembly of claim 4 wherein the surface for distributing mechanical stress comprises an elliptically-shaped structure.

7. The blade assembly of claim 4 wherein the surface for distributing mechanical stress is configured to extend over a segment encompassing at least half a width of the groove.

8. A blade group in a turbo-machine comprising:

a first blade comprising a first platform with a first surface;

a second blade comprising a second platform with a second surface located adjacent said first surface and forming a gap there between;

a groove formed in said first surface, the groove comprising a length and width in a plane of the first surface, the groove configured to linearly extend along a groove axis in a direction generally along an axis of rotation of the turbo-machine;

a cylindrical seal pin disposed in the groove, said seal pin having a circular cross-section along the groove axis, the seal pin having a first end proximate a first end of the groove and a second end proximate a second end of the groove, said seal pin operable to make sealing contact with the second surface to avoid leakage of a fluid through the gap, wherein each end of the groove comprises a first portion comprising a blocking surface generally normal to the groove axis, the blocking surface adjacent to each respective end of the seal pin, and each end of the groove further comprises a second portion comprising a lengthwise extension of the groove beyond the blocking surface; and a dam disposed between the groove and the lengthwise extension of the groove, the dam configured to radially extend from a bottom location at the end of the groove, the dam positioned substantially normal relative to the groove axis into a portion of the lengthwise extension of the groove, the dam constructed as an integral structure of the blade platform.

9. The blade group of claim 8, wherein said first portion of the end of the groove comprises a radially inner portion with respect to a rotor axis, and said second portion of the end of the groove comprises a radially outer portion with respect to the first portion.

10. The blade group of claim 8, wherein said lengthwise extension of the groove comprises a fillet configured to extend over a segment encompassing at least half a width of the groove.

11. A blade assembly in a turbo-machine comprising:

a blade having a platform section; and at least one groove formed in a surface of said platform section, the groove configured to linearly extend along a groove axis in a direction generally along an axis of rotation of the turbo-machine, the groove positioned to extend between adjacent blade assemblies in a common row of blades of the turbo-machine, the groove adapted to receive a cylindrical seal pin having a circular cross-section along the groove axis, the seal pin having at least one end proximate a corresponding end of the groove, said seal pin operable to make sealing contact with an adjacent platform section to avoid leakage of a fluid through a gap there between, wherein a first portion of said end of the groove comprises a mechanical stress dissipater comprising a curved surface for dissipating a peak mechanical stress there through by a pre-determined factor wherein a second portion of said at least one end of the groove comprises a fluid-deflecting surface positioned to impede the flow of fluid around the end of the seal pin, wherein the fluid-deflecting surface is positioned generally normal to the axis of rotation of turbo-machine, and wherein the curved surface is arranged to provide a transition from a surface disposed in the direction generally along the axis of rotation of the turbo-machine to a surface generally normal to the axis of rotation of the turbo-machine.

12. The blade assembly of claim 11 wherein the predetermined factor ranges from about 0.4 to about 0.8.

* * * * *